United States Patent [19]

Poage

[11] 4,026,445

[45] May 31, 1977

[54] BLOCKING BOARD

[76] Inventor: Gloria Poage, Rte. 7, Box 394, Roanoke, Va. 24018

[22] Filed: June 1, 1976

[21] Appl. No.: 691,761

[52] U.S. Cl. ..... 223/69; 38/102.9; 38/141

[51] Int. Cl.[2] ..... A41H 5/00

[58] Field of Search ..... 38/102–102.91, 38/141, 1; 223/69, 70, 49, 46; 28/2

[56] References Cited

UNITED STATES PATENTS

| | | | |
|---|---|---|---|
| 836,438 | 11/1906 | Coey | 38/102.91 |
| 2,160,337 | 5/1939 | McKee | 38/141 |
| 2,599,199 | 6/1952 | Roberts | 223/69 |
| 3,425,143 | 2/1969 | Feld et al. | 38/102.9 |

FOREIGN PATENTS OR APPLICATIONS

| | | | |
|---|---|---|---|
| 179,743 | 12/1935 | Switzerland | 223/69 |

*Primary Examiner*—G.V. Larkin
*Attorney, Agent, or Firm*—Beveridge, DeGrandi, Kline & Lunsford

[57] ABSTRACT

A board used for blocking handwork articles such as needlepoint articles, embroidered articles and the like. A flat board is provided with a plurality of openings extending therethrough, each opening have a first portion adjacent the board lower surface of a first diameter and a second portion adjacent the board upper surface of a second, smaller diameter. Pins are inserted from beneath the board into those openings which define the size and shape desired for the finished handwork article. Each pin has a head of a diameter such that the pinhead frictionally engages the sidewall of the first portion of its opening and a shaft of a diameter such that the pin shaft passes freely through the second portion of its opening to extend above the upper surface of the board. The article is stretched over and hooked on the pins. The article is dampened either before or after it is afixed by the pins so that the article dries blocked to the desired size and shape. When the article is to be removed from the blocking board, the board is inverted and tapped on a flat surface to push all the pins outward, freeing the article. Positioning guidelines may be provided on the board to assist in alignment of an article during the blocking process.

14 Claims, 2 Drawing Figures

BLOCKING BOARD

Figure 1:
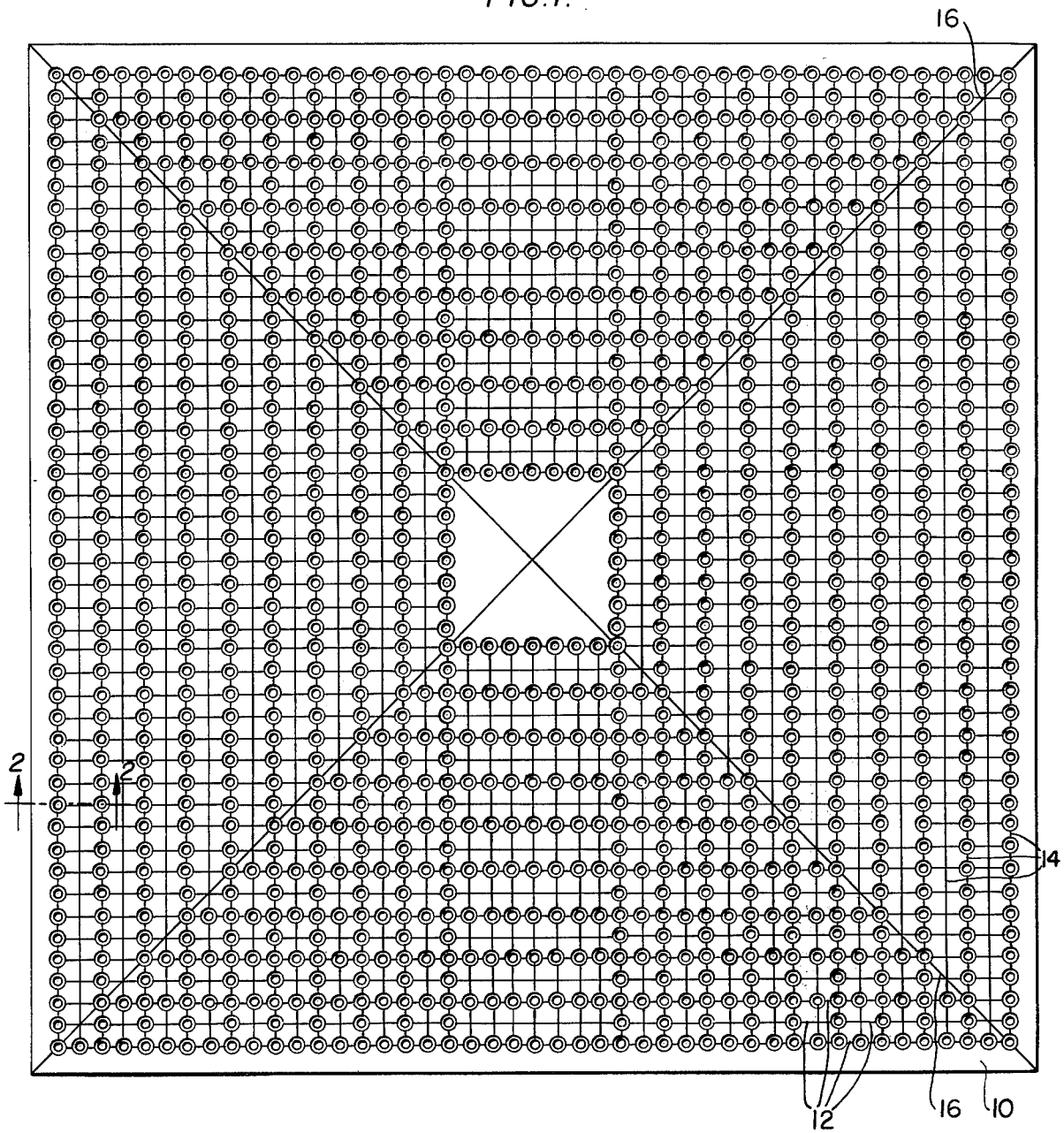

The present invention pertains to the blocking of handwork articles, such as needlepoint, crochet, embroidery and other handwork articles. More particularly, the present invention pertains to an improved blocking board by means of which handwork articles can be blocked to a desired size and shape.

In the process of making handwork articles, such as needlepoint, crewel, embroidery, knitted and crocheted articles and the like, the shape and proportions of the article frequently become distorted. It is therefore desirable to block the particular article before it is finished into a decorative piece such as a pillow, picture, chair or bench cover, bell pull or the like. The blocking process realigns the article by removing wrinkles and distortions of shape and size. After blocking the article retains its size and shape for a considerable time, generally many years.

The blocking process is usually accomplished by lightly wetting the article, for example by rolling it in a dampened towel or by mist spraying, and stretching the article into the desired size and shape and allowing the article to dry while stretched to that size and shape. A handwork article can be blocked by tacking a first portion of it on a board and inch by inch stretching further portions into the desired positions to give the desired size and shape, tacking the article to the board at various intervals as these further portions are positioned.

As an example, almost every piece of needlepoint which is not worked on a frame must be blocked after the needlework is finished. The canvas used in needlepoint generally contains a sizing compound in order to keep the threads aligned properly while the needlework is being done and in order to keep the canvas in shape after the needlepoint piece has been worked and blocked. Dampening the needlework and the surrounding canvas loosens the sizing, and when the article dries the sizing helps retain the newly blocked size and shape. In the blocking process it is important to have pins or tacks as close together as possible in order to prevent the article from developing a reverse scallop, since out of line threads which would result from a reverse scallop would show in the finished piece. The lightly dampened article is laid on a board, preferably wrong side up to prevent discoloration and is pinned or tacked along one edge to the board at intervals, say in the order of from about ¼ to about 2 inches depending upon the size of the article. The other edge of the article is then carefully stretched so that it is aligned with the pinned edge and this second edge is likewise pinned. This is continued until all the edges of the article are pinned in the desired positions. Articles that are not too far out of shape may be pinned while dry and then steamed or dampened. In either event as the needlepoint dries, the sizing in the canvas resets the threads in the new positions and the article retains the desired size and shape after blocking.

Likewise, after it has been stitched nearly all crewel work is blocked by washing the article, partially drying it, for example on a thick Turkish towel, laying the crewel work article on a blocking board face up so that the stitches are not raised or flattened and pinning the article in the desired size and shape. A pin is put at about the center of one edge of the article, and the article is then pulled from the other edge opposite the first pin and is pinned at about the center of the other edge. Additional pins are then placed along each edge. This process is repeated on each side. Extreme care is necessary to assure that the handwork article is properly positioned as the pins are placed around the article. This process permanently sets the stitches.

Heretofore without the use of large cumbersome equipment, such as utilized by commercial laundries to block handwork articles, it has been extremely difficult to block handwork articles in a manner maintaining an even tension over the entire article so that wrinkles are removed and the finished article has the desired size and shape. Various home techniques for blocking handwork articles have been utilized in the past. By way of example, the handwork articles might be pinned onto a board of plywood or of sytrofoam or onto an ironing board, utilizing for example pins of stainless steel. There are a number of disadvantages to such methods. For one thing there frequently is considerable difficulty in aligning the article into the desired size and shape. Additionally, it generally is cumbersome and difficult to simultaneously stretch, align, and pin the article on the board. Blocking boards have been developed into which pins can be preset for the handwork article to be stretched onto, as shown in several United States patents including, for example U.S. Pat. Nos. 2,118,880, 2,413,041, 2,966,759 and 3,425,143. Such blocking boards somewhat aleviate the problems involved in blocking handwork articles, but still these boards are often difficult to use, particularly since the pins may fall out as the article is being applied. Even then, after the article has dried it must be removed from the pins, and with most home techniques, and with many of the prior art blocking boards, the article cannot simply be stripped from the pins because the pins are inserted into the upper surface of the board, and so the pins must be removed one by one. This is tedious and time consuming.

The present invention is a blocking board for handwork articles by means of which articles can be readily stretched to the desired size and shape and pinned in place. The pins can be pre-inserted in the board with relative ease and are maintained in the board in the desired position, even though the board may be tilted, inverted, or otherwise moved to a different orientation.

The blocking board of the present invention may have any desired shape, advantageously square or rectangular. A large number of openings pass through the blocking board in a regular pattern, for example, being layed out in lines and rows so that the openings can readily define square and rectangles. Each opening includes a first portion of a first diameter adjacent the board lower surface and a second portion of a second diameter less than the first diameter adjacent the board upper surface. A plurality of pins are provided with the pins have enlarged heads, of a size to frictionally engage the opening first portions to retain the pins within the openings, and shafts of a size to freely pass through the second portion of the openings to extend above the upper surface of the board. Pins are inserted from beneath the blocking board into those openings which define the desired size and shape of the perimeter of the finished handwork article and the article is stretched over and hooked on the pins. The article is dampened either before or after it is affixed by the pins so that the article dries blocked to the desired size and shape. When it is desired to remove the article, the points of the pins are tapped on a flat surface to push all the pins outward, freeing the article.

Positioning guidelines may be placed on the board to assist in alignment of an article. The board can be made of any suitable rigid material, for example wood. Advantageously, the board can be made of a transparent material, for example a synthetic resin such as polycarbonates, polyvinychlorides, polyvinylidenes, methacrylates and acrylates and polymers and copolymers thereof, etc., preferably a material with a high degree of transparency. Additives such as plasticizers might also be employed to provide desired physical properties. Once the handwork article is pinned in place on the blocking board, the board can be lifted and the article viewed through the bottom to be certain that the article is in the desired orientation. Likewise, during such viewing various framing ideas can be considered to assure that the article is being blocked to the required size and shape. Preferably, the pins extend a significant distance above the upper surface of the board, for example a distance in the order of about one inch. In such instance the article can be inerted partway down the pins, for example one-half inch, so that the article is not abutting the upper surface of the board. This permits air circulation on both sides of the article, facilitating its drying.

Figure 2:
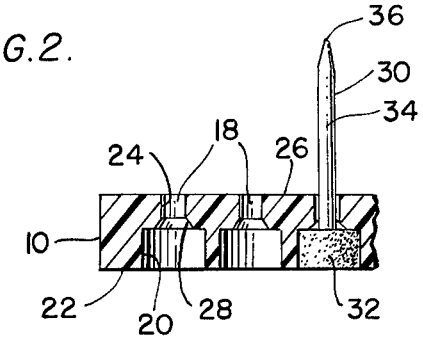

These and other aspects and advantages of the present invention are more apparent in the following detailed description, particularly when considered in conjunction with the accompanying drawings in which like parts bear like reference numerals. In the drawings:

FIG. 1 is a top plan view of a blocking board in accordance with the present invention, but without pins in place; and FIG. 2 is an enlarged sectional view taken along line 2—2 of FIG. 1 and showing a pin inserted in one of the holes of the blocking board in accordance with the present invention.

FIG. 1 illustrates a typical blocking board 10 in accordance with the present invention. Blocking board 10 may be made of wood, a synthetic, such as a clear plastic, or other suitable material. The dimensions of blocking board 10 may vary somewhat depending upon the desired use. By way of example, blocking board 10 might be square with sides of a length in the order of from about 16 inches to about 30 inches and with a thickness of from about one-fourth to about three-fourths inch, preferably about one-half inch. For the blocking of larger articles, two or more blocking boards such as blocking board 10 may be connected together, for example by clamps, to accommodate a longer rectangular article, or four or more blocking boards 10 may be connected together to form a larger square to accommodate a larger square article.

Preferably the upper surface of blocking board 10 is provided with horizontal guidelines 12, vertical guidelines 14 and diagonal guidelines 16 which can be marked or etched on the upper surface of blocking board 10. Guidelines 12 and 14 are spaced at regular intervals, say in the order of about one inch apart, and aid the user in positioning the pins to assure that the article to be blocked is correctly aligned to the desired size and shape. The vertical and horizontal guidelines 12 and 14 are preferably equally spaced to form squares and rectangles. Alternatively, the guidelines could be arranged in other patterns, for example circular guidelines equally spaced along a radial line from the center of blocking board 10 to form a plurality of concentric circles of increasing diameter. With horizontal and vertical guidelines such as guidelines 12 and 14, diagonal guidelines 16 are preferably provided to identify the corners of squares. As the article to be blocked is placed on the blocking board, it can readily be determined by reference to guidelines 12 and 14 whether the article is in a desired size and shape. Advantageously, blocking board 10 is made of a clear plastic material so that, after the article has been tentatively positioned, the board can be lifted and the article viewed through the board to verify that the article is in the desired position.

A plurality of holes 18 pass through blocking board 10, preferably in a regular geometric pattern. FIG. 1 illustrative shows holes 18 laid out in a plurality of horizontal rows and a plurality of vertical lines so that squares and rectangles of various dimensions can be defined. The rows and lines of holes 18 can be at any desired interval, for example at an interval in the order of from about ¼ to about 1 inch, preferably one-half inch. As seen in FIG. 2 each hole 18 includes a first portion 20, adjacent lower surface 22 of blocking board 10 and having a first diameter, and a second portion 24, adjacent upper surface 26 of board 10 and having a second diameter less than the diameter of first portion 20. By way of illustration, if blocking board 10 has a thickness of one-half inch, then first portion 20 might extend one-fourth inch into the blocking board. A funnel-like segment 28 joins first portion 20 and second portion 24 and might extend in the order of one-sixteenth inch, the balance of the thickness of the blocking board 10 being taken up with second portion 24. Illustratively, each first portion 20 might have a diameter in the order of about three-eights inch, and each second portion 24 might have a diameter in the order of about five-sixty-fourths inch.

FIG. 2 also illustrates a typical pin 30 having a head 32 of a diameter which frictionally engages the sidewalls of first portion 20. Head 32 might be formed of rubber, a synthetic resin, or other suitable material having sufficient friction to grippingly engage the sidewalls of first portion 20. Pin 30 has a shaft 34 of a diameter to fit freely through second portion 24 of hole 18, for example a diameter in the order of one-sixteenth inch. Preferably head 32 has a height substantially the same as the depth of first portion 20, for example a height in the order of one-fourth inch. Shaft 34 preferably has a length sufficient to cause it to extend significantly above upper surface 26, for example to extend in the order of about 1 inch. As illustrated, preferably shaft 34 terminates in a point 36 which is only slightly sharpened. Second portion 24 of holes 18 halts the inward insertion of pin 30 with pinhead 32 flush with lower surface 22 of blocking board 10. In addition, second portions 24 restrict the sideward movement of the pins as an article is stretched over the pins and cooperate with the close fit of the shafts 34 within the second portions 24 to reduce wear at the openings of holes 18 on upper surface 26. Preferably the shafts 34 of the pins 30 are formed of a noncorrosive material such as stainless steel or a synthetic resin so that the pins may be reused extensively. Advantageously, shafts 34 terminate in heads which are embedded within enlarged heads 32 of the pins 30.

When it is desired to block a handwork article by means of blocking board 10, pins 30 are inserted into those holes 18 which define the desired perimeter of the finished article, and the article is stretched over and hooked on the pins. Pins 30 can be inserted through each consecutive hole in the perimeter definition or pins might be inserted in, for example, every other hole if a large article is to be blocked. The article is dampened either before or after it is stretched and hooked onto the pins 30, and the article is allowed to dry in its stretched condition, thereby achieving the desired blocking. The frictional engagement of heads 32 in first portions 20 of the holes 18 assures that the pins are retained in the desired locations, not only during initial set-up of blocking board 10 but also as the handwork article is drying. Usually only one row of pins is inserted corresponding with the perimeter of the handwork article. However, if desired, additional rows could be utilized, for example arranged in concentric geometric shapes to distribute the tension which results from stretching of the handwork article.

One edge of the handwork article is hooked over the appropriate line of pins and the article is gently stretched and slide over the other pins until the entire article is in the desired size and shape. During the stretching process as well as afterwards the alignment of the article can be checked by comparison with the guidelines 12 and 14. This comparison provides constant assurance that the desired size and shape are attained. Likewise, if blocking board 10 is made of a transparent material the board can be lifted and the handwork viewed through the blocking board.

Once the handwork article has dried, pins 30 are removed. Advantageously this can be done by placing the pin points 36 in contact with a flat surface and pushing on blocking board 10 to force all of the pins 30 out of their holes 18.

Although the present invention has been described with reference to a preferred embodiment numerous modifications and rearrangements could be made and still the result would be within the scope of the invention.

What is claimed is:

1. A blocking board comprising a board member having an upper surface and a lower surface with a plurality of openings extending through said board member from said lower surface to said upper surface, each opening including a first portion adjacent said lower surface having a first diameter and a second portion adjacent said upper surface having a second diameter less than said first diameter; and a plurality of pins, each pin having a head of a diameter to frictionally engage the sidewalls of said opening first portions when the head is inserted into the openings and having a shaft of a diameter freely passing through said opening second portions.

2. A blocking board as claimed in claim 1 in which one of said board member upper surface and said board member lower surface has positioning quidelines thereon.

3. A blocking board as claimed in claim 2 in which said positioning guidelines are on said board upper surface.

4. A blocking board as claimed in claim 2 in which said positioning guidelines include a plurality of horizontal lines and a plurality of vertical lines, said horizontal lines and said vertical lines intersecting to permit definition of squares and rectangles of various dimensions.

5. A blocking board as claimed in claim 4 in which said positioning guidelines further include diagonal lines.

6. A blocking board as claimed in claim 5 in which said board member is a square member and in which said diagonal lines extend between the diagonally opposite corners thereof.

7. A blocking board as claimed in claim 1 in which said board member is made of wood.

8. A blocking board as claimed in claim 1 in which said board member is made of a transparent material.

9. A blocking board as claimed in claim 8 in which said transparent material is a synthetic resin.

10. A blocking board as claimed in claim 1 in which said board member is made of a synthetic resin.

11. A blocking board as claimed in claim 1 in which said pin heads are made of a synthetic resin.

12. A blocking board as claimed in claim 1 in which said pin heads are made of rubber.

13. A blocking board as claimed in claim 1 in which said pin shafts are made of stainless steel.

14. A blocking board as claimed in claim 1 in which said pin shafts are made of a synthetic resin.

* * * * *